United States Patent [19]

Gourdine

[11] Patent Number: 4,671,805

[45] Date of Patent: Jun. 9, 1987

[54] METHOD FOR AIRPORT FOG PRECIPITATION

[75] Inventor: Meredith C. Gourdine, East Orange, N.J.

[73] Assignee: Energy Innovations, Inc., East Orange, N.J.

[21] Appl. No.: 580,477

[22] Filed: Feb. 15, 1984

[51] Int. Cl.[4] ..... B03C 9/00; E01H 13/00; B05B 5/02

[52] U.S. Cl. ..... 55/10; 55/107; 55/385 R; 239/3; 239/2.1; 239/14.1; 239/14

[58] Field of Search ..... 55/5, 10, 105, 106, 55/107, 122, 385 R; 361/227, 228; 98/1; 244/114 R; 239/2 R, 3, 14

[56] References Cited

U.S. PATENT DOCUMENTS

| | | | |
|---|---|---|---|
| 1,928,963 | 10/1933 | Chaffee | 55/5 |
| 3,600,653 | 8/1971 | Hall | 55/5 |
| 3,601,313 | 8/1971 | Owe Berg | 55/107 |
| 3,757,491 | 9/1973 | Gourdine | 55/107 |
| 4,475,927 | 10/1984 | Loos | 239/3 |

FOREIGN PATENT DOCUMENTS

| | | | |
|---|---|---|---|
| 587521 | 4/1947 | United Kingdom | 98/1 |

OTHER PUBLICATIONS

Chiang, T. K. and Gourdine, M. C., "Field Evaluation of an Electrogasdynamic Fog Dispersal Concept", Part 1, Technical Report FAA-RD-73-33 Dept. of Transportation, Fed. Aviation Admin. Feb. 1973.

Wright, T. and Clark, R., "Field Evaluation of an Electrogasdynamic Fog Dispersal Concept", Part 2, Technical Report, FAA-RD-73-33, Dept. of Transportation, Fed. Aviation Administration, Feb. 1973.

James E. Jiusto, Laboratory Evaluation of an Electrogasdynamic Fog Dispersal Concept, Federal Aviation Administration, Aug. 1972.

*Primary Examiner*—David L. Lacey

*Attorney, Agent, or Firm*—Brumbaugh, Graves, Donohue & Raymond

[57] ABSTRACT

Atmospheric occurrences that decrease visibility, particularly fog, smoke, smog and the like, are cleared at sites such as airports by an array of EGD spray units emitting submicron size charged water droplets to attach to airborne particulates and electrostatically precipitate those to ground. Independent variables of the array and the EGD jets from the spray units are controlled to control the dependent variables characterizing the space-charge cloud thus developed. The methods and apparatus control the height to which clearing of the airborne particulates occurs to improve visibility and the time required for such clearing. Specific compact spray units are self-contained, can be radio operated, and are movable. Placement of the units for removal of radiation and advection fog with respect to airport runways include a square array of the spray units proximate the runway for radiation fog control and upwind location of arrays for advection fog precipitation. Specific characteristics of small, medium and large spray units suitable for use in the arrays are set forth.

19 Claims, 6 Drawing Figures

METHOD FOR AIRPORT FOG PRECIPITATION

BACKGROUND OF THE INVENTION

This invention relates to the precipitation of fog and more particularly to the precipitation thereof by EGD (electrogasdynamic) spray systems emitting submicron size charged water droplets.

The airline industry loses hundreds of millions of dollars annually due to airport shutdowns by fog. Even at those airports where fully automatic take off and landing is possible for large commercial flights, the extreme care required for ground movement of planes severely slows scheduled arrivals and departures. Because of the danger and cost that this weather brings, systems for dispersing fog have been proposed.

Warm fogs (above 32° F.) are far more frequent than cold fogs (below 32° F.). What is needed is a technique for fog dispersal that is capable of handling warm or cold fogs. There are two types of warm fogs; radiation (little or no wind), and advection (wind). Seeding these warm fogs with hygroscopic crystals dropped from airplanes was found to be unreliable, so thermal systems were developed.

Thermal systems use jet engines to inject heat into the warm fog over a runway and its approach. Raising the temperature of the fog a few degrees causes the water drops to evaporate, and the range of visibility to increase. Because such systems have limitations and bad side effects, only two such systems have been installed (both in France). Operationally, the systems cause so much turbulence that they must be off while planes land, and only large planes can land safely in the residual turbulence. Thus, the frequency of landings and the types of airplanes are both restricted by the thermal fog dispersion system. The thermal system necessarily consumes large amounts of fuel, and its exhaust pollutes the atmosphere. It would be cost effective only at a few of the world's largest, and busiest airports with frequent fog shutdowns.

Electrostatic precipitation of fog drops, much like cleaning of air of suspended dust in an electrostatic precipitator, has been considered by many investigators. However, it was generally agreed that the installation of electrodes above a runway would be highly impractical. Seeding the fog with electrically charged particles from an airplane was considered as an alternative, but this approach has so many operational difficulties that a ground based system is preferred.

The inventor's U.S. Pat. No. 3,757,491, "Apparatus for Suppressing Airborne Particles", Sept. 11, 1973, incorporated herein by reference, describes apparatus for injecting submicron size charged water droplets into airborne contaminants such as dust and inducing an electrostatic field that causes the thus charged contaminant particles to precipitate. EGD nozzles suitable for use in the practice of this invention are known. One such is disclosed in the inventor's U.S. patent application Ser. No. 310,534, filed Oct. 31, 1981, now U.S. Pat. No. 4,433,003 assigned to the assignee of the present invention, and incorporated herein by reference. Fog suppression by emission of charged particles from an electrogasdynamic (EGD) gun, was described by Chiang, T. K., and Gourdine, M. C., "Field Evaluation of an Electrogasdynamic Fog Dispersal Concept", Part 1, Technical Report, FAA-RD-73-33 Department of Transportation, Federal Aviation Administration, February 1973. This was successfully tested in a fog chamber, J. E. Jiusto, "Laboratory Evaluation of an Electrogasdynamic Fog Dispersal Concept", Technical Report FAA-RD-72-99, Department of Transportation, Federal Aviation Administration August 1972, and also in a small field test in the Panama Canal Zone, Wright, T. and Clark, R., "Field Evaluation of an Electrogasdynamic Fog Dispersal Concept", pp. 25–26, I and p. A-2, Part 2, Technical Report, FAA-RD-73-33, Department of Transportation, Federal Aviation Administration, February 1973. However, to the inventor's knowledge, no one has deployed, or taught how to deploy, EGD spray guns around an airport such that visibility is maintained to a specified height above the runway and approach, and in winds of various speed.

SUMMARY OF THE INVENTION

In accordance with this invention EGD apparatus is deployed in an array and used for the precipitation of fog over airports, the EGD apparatus operating parameters being adjusted to provide, according to a mathematical model described herein, a charged droplet cloud of chosen characteristics. The invention avoids the above-described limitations of thermal systems, it does not pollute the atmosphere or cause heavy turbulence, and it is cost effective even in small airports. The methods and apparatus according to the invention are believed to be the only approach available at the present time to handle warm or cold fogs practically and effectively. The array of EGD nozzles arranged and operated according to the invention avoids the use of electrodes above a runway. Preferably the inventive array is ground based, and can be installed quickly and inexpensively without the need to excavate or dig trenches for laying of underground pipes and storage tanks.

In embodiments of the method and apparatus according to the invention, numerous self-contained EGD spray systems are deployed, spaced a mean distance S apart from each other in an array. For large arrays employing numerous spray units, this mean distance or spacing S closely approaches $\sqrt{N/A}$, where N is the number of units and A is the area of an array. Each of the systems emits submicron sized charged particles of a radius a. Preferably the array is a square array, the EGD nozzles of the array forming corners of a grid of squares having sides of length S. In the case where the spray units are deployed in an array on each side of an airport runway, for example, the mean spacing S is determined taking into account any increased spacing across the runway such as may be required by safety considerations and regulations. The array provides a cloud of the submicron charged particles of radius a and mobility $k_a$ spreading upwards and outwards by turbulent and electrostatic diffusion, the cloud having a charge droplet concentration $q_a n_a$, where $q_a$ is the charge on a droplet and $n_a$ is the droplet concentration, extending to a height H. The cloud has a maximum electric field strength $E_x(0)$ at the ground, zero field strength at the top, and a time constant $\tau$ determinative of the time required for acceptable fog clearance by precipitation. EGD nozzles in the array are fashioned and adjusted to provide preselected independent variables including the spacing S of the nozzles, the kinetic power $P_j$ of the jet from each nozzle, the current $I_j$ in the jet, and the mobility $k_a$ of the charged submicron particles emitted.

The tiny charged droplets produced in accordance with the invention will attach themselves to any other particles that may be suspended in the space charge cloud. Assume a quiescent fog and no relative motion between the fog drops and the tiny charged droplets other than their electrostatically induced drift speeds earthward, which must eventually vanish. If these drops have a radius $b \geqq a$, they can acquire maximum charge $q_b = q_a(b/a)^2$, which gives them the same mobility as the droplet; i.e. $k_b = k_a$. However, in fogs having substantial atmospheric turbulence large drops do not follow small scale turbulent fluctuations as well as small charged droplers, so there is considerable relative motion, and the large fog drops increase their mobility by attaching more small droplets. This process of turbulent charging is limited only by the fact that the induced field at the surface of a charged fog drop may eventually reach the breakdown strength of the air, $E_b$; then no additional charge can be acquired. At this limit $k_b/k_a = (q_b/q_a)(a/b) = b/a$. Therefore, depending on the amount and type of atmospheric turbulence, including turbulence introduced by the spray units, the ratio of charged fog drop mobility to charged droplet mobility will be in the range $1 \leqq k_b/k_a \leqq b/a$. Thus, the rate of loss of fog drops, or other particles, from a volume $S^2H$, around a spray unit, equals the rate at which charge fog drops diffuse to the ground in the area $S^2$ around a spray unit; i.e.

$$\frac{d}{dt}(n_b S^2 H) = -n_b k_b E_x(0)\, S^2, \tag{1}$$

wherein $n_b$ is the concentration of fog drops (assumed to be uniform due to turbulence).

Upon integration, $$n_b(t)/n_b(0) = \exp(-t/\tau), \tag{2}$$

where $n_b(t)$ is the fog drop concentration at time t measured from a hypothetical time 0 when a full space-charge cloud of chosen characteristics has been established and prior to precipitation of fog, $n_b(0)$ is the fog drop concentration initially, and where the time constant is $$\tau = \frac{H}{k_b} E_x(O). \tag{3}$$

The inventor has found that the range of visibility V is inversely proportional to the fog concentration n, so $$V(t)/V(0) = \exp(t/\tau). \tag{4}$$

V(t) being the visibility at time t, and V(0) the initial visibility.

In accordance with this invention, the dependent variables H, $q_a n_a$, $E_x(0)$ and $\tau$ characterizing the space-charge cloud are provided by control of array and EGD nozzle independent variables using the inventor's newly developed relationships $$E_x(0) = (3/\epsilon_o)^{\frac{1}{3}} P_j^{\frac{1}{3}} k_a^{-\frac{1}{3}} S^{-\frac{2}{3}}, \tag{5}$$

$$H = 3^{\frac{2}{3}} \epsilon_o^{5/3} P_j^{\frac{2}{3}} k_a^{\frac{1}{3}} S^{\frac{2}{3}} / I_j, \tag{6}$$

$$q_a n_a = 3^{-\frac{1}{3}} \epsilon_o^{-\frac{1}{3}} P_j^{-\frac{1}{3}} k_a^{-\frac{2}{3}} S - 4/3 I_j, \tag{7}$$

$$\tau = 3^{\frac{1}{3}} \epsilon_o^{\frac{2}{3}} P_j^{\frac{1}{3}} S^{4/3} I_j^{-1} k_a^{-\frac{1}{3}} (k_b/k_a)^{-1} \tag{8}$$

where $\epsilon_o$ is the permittivity of free space.

Thus, atmospheric turbulence has the direct effect of decreasing $\tau$ by increasing $k_b/k_a$. It also has more subtle indirect effects on the other dependent variables of the space-charge cloud by increasing the effective value of $P_j$. Usually, uneven heating of the atmosphere induces turbulence. If this thermal power addition to the volume $S^2H$ is designated $P_t$, it may be considered an addition to the kinetic power $P_j$ of the EGD jet in that volume. Thus, according to eq. (6), turbulence increases the height of the space-charge cloud from H to H', where $$H'/H = [(P_j + P_t)/P_j]^{\frac{2}{3}}$$

and according to eq. (8), the time constant is changed from $\tau$ to $\tau'$, where $$\tau'/\tau = [P_j + P_t)/P_j]^{\frac{1}{3}} (k_b/k_a)^{-1}$$

Thus, in most cases of interest the time constant is reduced because the effect of increased mobility is dominant.

The principles of this improved fog precipitation array can be employed to successfully precipitate fog under varying conditions. Precipitation of fog drops being transported by a wind towards an airport is achieved in one case by extending the regular array of EGD nozzles a distance y=ut upwind from the runway, thereby giving the fog time t to precipitate before reaching the runway, where u is the speed of the moving fog. Again, employment of the principles of this invention provides determination of the height to which the fog may be cleared, and the time necessary to do so. In another specific embodiment, a row or a few rows of the EGD nozzles are located a distance $y' > y$ upwind of the runway to establish a space charge cloud at that location having the characteristics of the aforementioned regular array. Precipitation occurs as the wind transports the space-charge cloud. Preferable large EGD spray units are used in this embodiment to establish the full height of a space charge cloud as quickly as possible. However, provided they are located relatively far from the runway, smaller units can accomplish the same result if mounted on tall poles. Areas downwind of the runway will have visibility restored as runway visibility is restored. In this and other embodiments where fog is cleared at airports, areas around terminals, hangers, and parking lots can also have improved visibility either by employment of EGD nozzles in the area or by virtue of drifting of the space charge cloud and upstream clearing of fog.

In accordance with another feature of the invention, self-contained, compact EGD spray units are provided that can easily be moved to specified locations around an airport. These can be controlled by radio and have low maintenance and fuel costs. Preferably, a supersonic steam jet injects charged submicron size droplets of condensate into the atmosphere. The steam is generated by heat from a propane-air flame, and the water from which the steam is generated is pumped by the propane gas pressure, making the system mobile and silent, there being no movable parts. The mobile EGD spray units are compact and light-weight making them easily deployed in arrays of the kind described herein.

Another type of EGD spray unit utilizes a jet of compressed air to transport submicron size charged water droplets into the fog. Such units have a propane driven engine driving a compressor whose output is humidified in a bubbler before entering the EGD nozzle where water vapor condenses on molecular ions from a corona discharge to form the charged droplets. These air-driven units are also independent, compact, and mobile.

The above and further advantages of the invention will be better understood with respect to the attached drawings taken in consideration with the following detailed description of the preferred embodiments.

DESCRIPTION OF PREFERRED EMBODIMENTS

Radiation Fog

Figure 1:
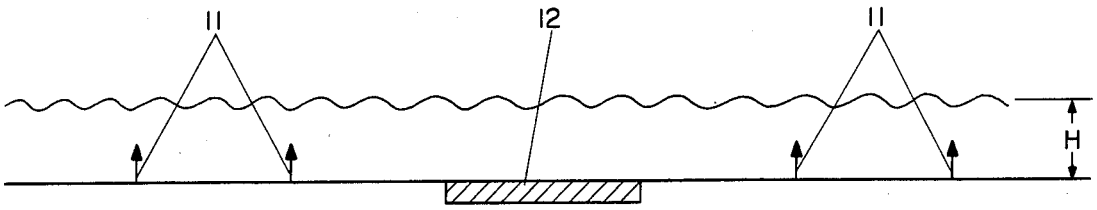
FIG. 1 is a schematic illustration of a runway flanked by EGD fog precipitation unit arrays looking in the direction of the runway.
Figure 2:
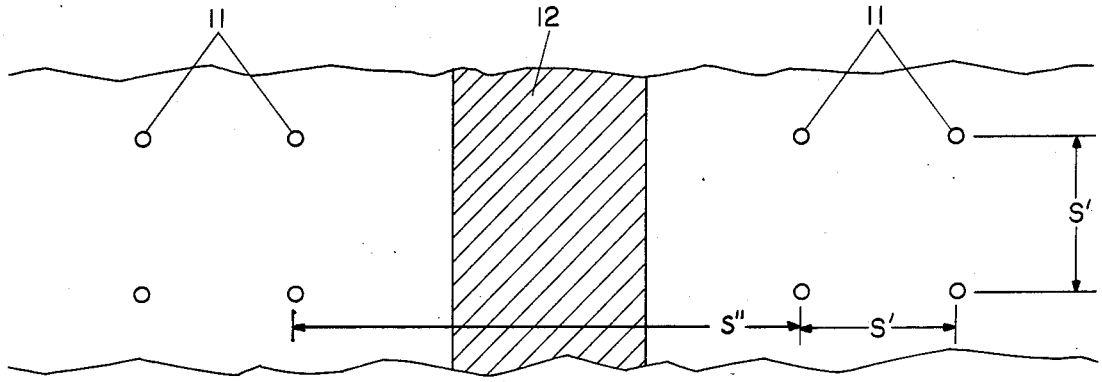
FIG. 2 is a fragmentary schematic top view of the runway and arrays of FIG. 1.

FIGS. 1 and 2 show the deployment of EGD fog precipitation units 11 in two rows on both sides of a runway 12. The units 11 are spaced a distance S' apart in square arrays. The array in this case spans the runway 12 and the increased distance S'' as well as the smaller spacing S' is taken into consideration in determining the mean spacing S referred to below. These EGD spray units produce and maintain a uniform space-charge cloud of concentration $q_a n_a$ above the runway to a height H. The space-charge induced electric field is directed downward, and is zero at the top and $E_x(0)$ at the ground.

Pursuant to the equations (1) to (4) above, the change with time of fog drop concentration $n_b$, and range of visibility V is given by the formula $$n_b(0)/n_b(t) = V(t)/V(0) = exp(t/\tau),$$

where the time constant $\tau = (H/k_b)E_x(0)$, measured from the hypothetical time 0 of establishment of the space-charge cloud of the desired characteristics, $n_b(0)$ is the fog drop concentration initially, $n_b(t)$ is the fog drop concentration at time t, likewise measured from the hypothetical time 0 when the full space-charge cloud has been established but before precipitation of fog has begun, V(t) is the visibility at the time t, and V(0) is the initial visibility.

The relationships between the dependent variables, H, $q_a n_a$, $E_x(0)$, and $\tau$ in terms of the independent variables (or parameters) S, P, $I_j$ and $k_a$, are determined by the following equations:

Poisson's space-charge equation $$E_x(0) = q_a n_a H/\epsilon_o, \tag{9}$$

Conservation of charge

-continued $$I_j = q_a n_a k_a E_x(0) S^2, \tag{10}$$

Conservation of energy $$P = \int_o^H q_a n_a K_a E_x^2 \, dx S^2 = q_a n_a k_a E_x^3(0) S^2 H/3. \tag{11}$$

where, $\epsilon_o$ is the permittivity of free-space.

Solving equations (9) to (11) simultaneously yields the equations (5)-(8), above. To wit $$E_x(0) = (3/\epsilon_o)^{\frac{1}{3}} P_j^{\frac{1}{3}} k_a^{-\frac{1}{3}} S^{-\frac{2}{3}}, \tag{5}$$

$$H = 3^{\frac{2}{3}} \epsilon_o^{5/3} P_j^{\frac{2}{3}} k_a^{\frac{1}{3}} S^{\frac{2}{3}}/I_j, \tag{6}$$

$$q_a n_a = 3^{-\frac{1}{3}} \epsilon_o^{-\frac{1}{3}} P_j^{-\frac{1}{3}} k_a^{-\frac{2}{3}} S^{-4/3} I_j, \tag{7}$$

$$\tau = H/k_b E_x(0) = 3^{\frac{1}{3}} \epsilon_o^{\frac{2}{3}} P_j^{\frac{1}{3}} S^{4/3} I_j^{-1} k_a^{-\frac{1}{3}} (k_b k_a)^{-1}. \tag{8}$$

Using equations 3, 5, 6, 7, and 8 (with $k_b/k_a = 1$) and the operating characteristics of three different sized EGD spray nozzles of large, medium and small size, the following Table I summarizes the characteristics of the space-charge clouds that result.

TABLE I

| | LARGE | MEDIUM | SMALL |
|---|---|---|---|
| RADIUS, $r_j$ (m) | $3.12 \times 10^{-3}$ | $1.56 \times 10^{-3}$ | $1.00 \times 10^{-3}$ |
| CURRENT, $I_j$ (amp) | | | |
| (Er(0) = $10^6$ v/m) | $160 \times 10^{-4}$ | $80 \times 10^{-5}$ | $5.13 \times 10^{-5}$ |
| $q_a/m_a = I_j/M_a$ (coul/kg) | $1.25 \times 10^{-1}$ | $2.5 \times 10^{-1}$ | $3.92 \times 10^{-1}$ |
| DROPLET MOBILITY ka($m^2$/volts sec) | $.6 \times 10^{-7}$ | $1.2 \times 10^{-7}$ | $1.9 \times 10^{-7}$ |
| AIR FLOW (kg/sec) | $2.45 \times 10^{-2}$ | $6.13 \times 10^{-3}$ | $2.52 \times 10^{-3}$ |
| JET SPEED (m/sec) (M = 1.35) | 415 | 415 | 415 |
| JET POWER $P_j$ (watts) | 1288 | 322 | 132 |
| Power Input (hp) (n = 20%) | 16 | 4 | 1.64 |
| WATER FLOW RATE | | | |
| (Kg/sec) | $1.28 \times 10^{-3}$ | $3.19 \times 10^{-4}$ | $1.31 \times 10^{-4}$ |
| H (m) | 32 | 32 | 32 |
| S (m) | 129 | 129 | 129 |
| $q_a n_a$ (coul/$m^3$) | $2.1 \times 10^{-7}$ | $1.05 \times 10^{-7}$ | $6.8 \times 10^{-8}$ |
| $E_x(0)$ (volts/m) | $7.6 \times 10^5$ | $3.8 \times 10^5$ | $2.5 \times 10^5$ |
| $\tau$ (sec) | 702 | 702 | 702 |

Note that the time constant for clearing to a specified height is independent of EGD nozzle size. Since the jet power required decreases with jet radius squared, it is preferred to use the small EGD nozzle and save fuel and size of the motor and compressor in a self-contained unit of the kind described below.

Whereas the characteristics set forth in Table I are preferred, the overall range of characteristics of usable arrays should be:

$E_x(0) \cong 10^5$ to $10^6$ volts/m $H \geqq 20$ m $q_a N_a \cong 10^{-8}$ to $10^{-6}$ coulombs/$m^3$ $\tau \leqq 1{,}000$ sec.

$S \cong 100$ to 150 m.

$P_j \cong 50$ to 2000 watts $I_j \cong 10^{-5}$ to $10^{-3}$ amp $K_a \cong 10^{-8}$ to $10^{-6}$ $m^2$/volts sec.

More particularly, an array of large nozzles, i.e. ones with jet radii in the range from $2.25\times10^{-3}$ to $4\times10^{-3}$ m. should have the following range of characteristics:

$E_x(0)\geqq7\times10^5$,
$q_aN_a\geqq1.5\times10^{-7}$,
$S\cong100$ to 150 m,
$P_j\cong1100$ to 1400 watts,
$I_j\cong1\times10^{-4}$ to $2\times10^{-4}$ amps, and
$K_a\cong1\times10^{-8}$ to $1\times10^{-7}$ $m^2$/volts sec.

Likewise, an array of medium size nozzles, i.e. ones having jet radii in the range from $1.25\times10^{-3}$ to $2.25\times10^{-3}$ m. should have the following range of characteristics:

$E_x(0)\cong3\times10^5$ to $4.5\times10^5$ volts/m,
$q_aN_a\geqq7.5\times10^{-8}$ coulombs/$m^3$,
$S\cong100$ to 150 m,
$P_j\cong200$ to 400 watts
$I_j\cong7\times10^{-5}$ to $1\times10^{-4}$ amps
$K_a\cong1\times10^7$ to $1.5\times10^{-7}$ $m^2$/volts sec.

An array of small nozzles (jet radii $0.25\times10^{-3}$ to $1.25\times10^{-3}$ m) should have the following range of characteristics:

$E_x(0)\cong2\times10^5$ to $3\times10^5$ volts/m,
$q_aN_a\geqq6\times10^{-8}$ coulombs/$m^3$,
$S\cong100$ to 150 m,
$P_j\cong100$ to 200 watts,
$I_j\cong4\times10^{-5}$ to $7\times10^{-5}$ amps,
$K_a\cong1.5\times10^{-7}$ to $2.5\times10^{-7}$ $m^2$/volts sec.

It should be noted, however, that it takes longer to establish the space-charge cloud with smaller nozzles, because they inject less charge and fewer droplets into the atmosphere, and turbulent diffusion is slower. As an illustrative example, consider a radiation fog (no wind) with initial visibility $V(0)=150$ m. It can be determined how long it would take to achieve a visibility $V(t)=300$ m; according in equation (4), $V(t)/V(0)=2$, $t/\tau=0.633$, and, according to Table I, $\tau=702$ sec; so, $t=487$ sec$=8.1$ min. Since it usually takes much longer than this for a radiation fog of this visibility to form, this system could suppress fog formation if turned on early and kept on until weather conditions change.

Equations (5)–(8) show that the space-charge cloud variables, H, $q_an_a$, $E_x(0)$ and $\tau$ are proportional to the independent variables, S, P, $I_j$, $k_a$ raised to certain exponential powers. These are summarized in the following convenient Table II.

TABLE II

| | S | $P_j$ | $I_j$ | $k_a$ | $k_b/k_a$ |
|---|---|---|---|---|---|
| $E_x(0)$ | $-\frac{2}{3}$ | $\frac{1}{3}$ | 0 | $-\frac{1}{3}$ | 0 |
| H | $\frac{2}{3}$ | $\frac{2}{3}$ | $-1$ | $\frac{1}{3}$ | 0 |
| $q_an_a$ | $-4/3$ | $-\frac{1}{3}$ | 1 | $-\frac{2}{3}$ | 0 |
| $\tau$ | 4/3 | $\frac{1}{3}$ | $-1$ | $-\frac{1}{3}$ | $-1$ |

Table III and the preceding equations (5–8) establish that increasing the mobility ka of the emitted like--charged droplets increases the height H and decreases the charge concentration qa na, and inversely, that decreasing the mobility ka decreases the height H while increasing the charge concentration qa na.

As an example of the usefulness of Table II, consider increasing the height of the space-charge cloud to $H_1=64$ m; that is, $H_1/H=2$. One way to do this is to increase mobility by the factor $k_{a1}/k_a=(H_1/H)^3=8$ for example by decreasing the droplet size. It should be noted that the factor $\tau_1/\tau=(k_{a1}/k_a)^{-\frac{1}{3}}32$ 0.50.

This invention, then, provides a practical way to adjust the apparatus to achieve the desired mobility without affecting the other independent variables. This arrangement of EGD spray units is ideally suited for precipitating warm or cold radiation fogs in little or no wind. It can also prevent the formation of such fog if it is turned on early, and kept on until the conditions for fog formation cease to exist.

Advection Fog

Further embodiments of this invention provide for deployment of EGD spray units in order to precipitate fog drops being transported by wind at a speed u, in a direction y, over the ground. One method requires that the regular array of units be extended a distance $y=u\ t$ upwind from the runway, thereby giving the fog time t to precipitate before reaching the runway.

Figure 3:
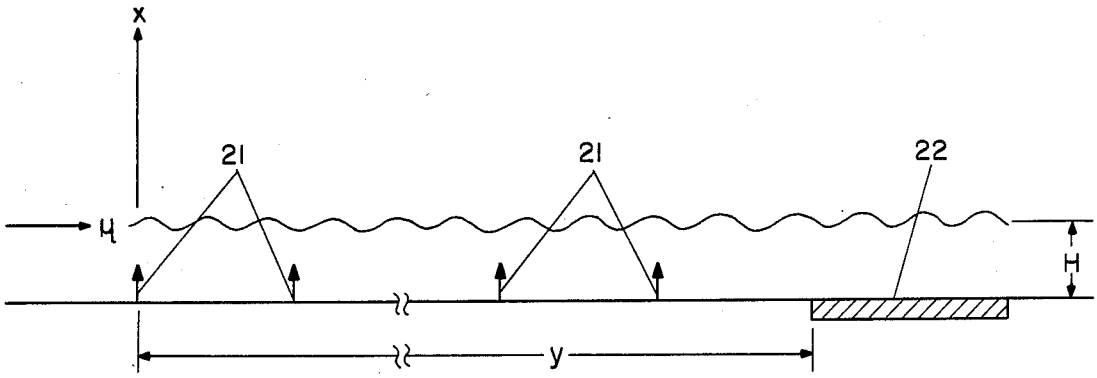
FIG. 3 is a schematic illustration, again looking in the direction of the runway, and illustrating the extension of an array upwind of the runway to precipitate fog being carried by wind across the runway.

FIG. 3 illustrates the deployment of EGD spray units 21 in order to precipitate a fog being transported across a runway 22 by a wind of speed u. The regular square array of EGD spray units (represented by the vertical arrows shown on the ground at 21), is extended a distance y upwind from the runway. This array of EGD spray units establishes and maintains a space-charge cloud of uniform concentration $q_an_a$, to a height H, over the distance y, with an induced downward electric field that is zero at the top of the cloud, and $E_x(0)$ on the ground.

As an illustrative example, consider an advection fog with initial visibility $V(0)=150$ m, moving with speed $u=5$ mph$=2.24$ m/s across the runway. The time required to increase the visibility to $V(t)=300$ m is again $t=487$ sec.$=8.1$ min; so, the array of EGD spray units must be extended upwind from the runway a distance $y=u\ t=1090$ m$=0.676$ mile.

As a function of distance y, the change in fog drop concentration $n_b$, and visibility V, is given by the formula $$n_b(y)/n_b(r)=V(r)/V(y)=exp(y/\lambda),$$

where $n_b(y)$ is the fog drop concentration at the distance y from the runway, $n_b(r)$ is the fog drop concentration at the runway, V(r) is the visibility at the runway, V(y) is the visibility at the distance y, and where the characteristic length is $$\lambda = u\tau = u\frac{H}{k_b}E_x(0).$$

Figure 4:
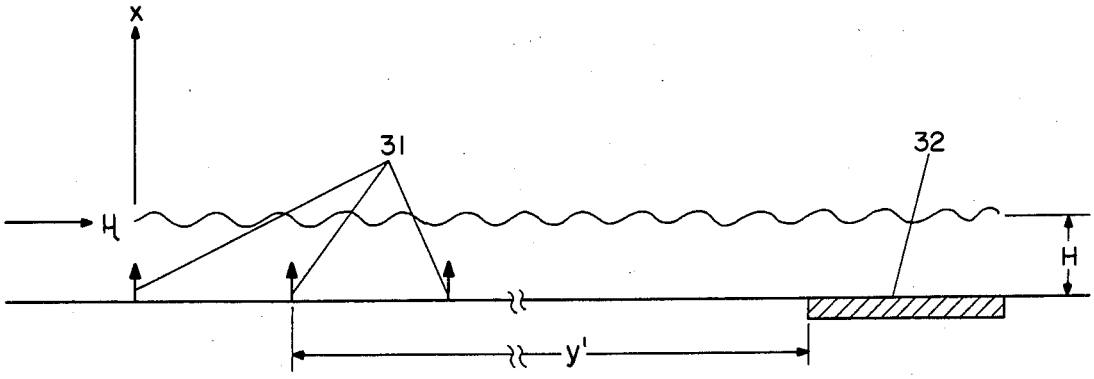
FIG. 4 is a further schematic illustration looking in the direction of the runway, and shows an EGD fog precipitation unit array upwind from the runway.

In another method of precipitating fog before wind carries it over the runway, instead of extending the regular array of EGD units a distance y upwind from the runway, a row (or a few rows) of EGD units is installed a distance $y'>y$ upwind from the runway. FIG. 4 shows this alternate deployment of the EGD spray units 31 used to precipitate an advection fog carried by a wind of speed u across the runway 32, the distance y' being measured from the runway to the middle of the array. The purpose of these EGD units is to establish a space-charge cloud extending downwind having similar characteristics as the regular array characteristics of Table I. However, as the wind transports the space-charge cloud towards the runway precipitation occurs, so the space-charge concentration and the electric field at the ground decreases as the runway is approached. The height of the space-charge cloud remains constant, because there is no electric field at this altitude. Fog drops become charged as they pass over the row (or rows) of EGD units and gradually precipitate as the wind carries them towards the runway.

Above the EGD spray units at y', the space-charge concentration is $q_a n_a(y')$ and the field at the ground is $E_x(0,y')$. Further downwind these values decrease due to precipitation of the space-charge, according to the formula $$\frac{q_a n_a(r)}{q_a n_a(y')} = \frac{E_x(0,r)}{E_x(0,y')} = \frac{1}{1 + y'/\lambda},$$

where $q_a n_a(r)$ is the space-charge concentration at the runway, $E_x(0,r)$ is the field strength at the ground at the runway, and where the characterisic length $$\lambda = u\tau(y') = \frac{H}{k_b} E_x(0,y').$$

As a function of distance y', the fog concentration $n_b$ and the range of visibility V, are found to vary according to the formula $$n_b(y')/n_b(r) = V(r)/V(y') = 1 + y'/\lambda,$$

where $n_b(y')$ is the fog drop concentration at y', $n_b(r)$ is fog drop concentration at the runway, V(r) is visibility at the runway and V(y') is visibility at y'.

In the same illustrative example mentioned above, $$V(y')/V(r) = 2; \text{ therefor } y'/\lambda = 1, \text{ and}$$

$$y' = \lambda = u\tau = 2.24 \times 702 = 1270\ m = 0.977 \text{ mile.}$$

The advantage of the deployment of FIG. 4 over the previous one of FIG. 3 is that much fewer EGD spray units are required. However, because y'>y, more real estate upwind of the runway must be used.

Although the space-charge cloud concentration decreases as the runway is approached, the height of the cloud remains constant because there is no electric field at the height H. In this case, it is recommended that, for ground-based units, the large EGD spray units be used in order to establish the full height of the uniform space-charge cloud within a short distance of the EGD spray units as quickly as possible. However, the small units can accomplish the same thing if they are mounted on tall poles. These poles can be installed without hazard because they are so far from the runway.

For either the FIG. 3 or the FIG. 4 method of deployment for advection fog, consideration must be given to the prevalent direction and speed of the wind and range of initial visibility of fogs that a particular runway might encounter. This requires a study of the history of fogs encountered at that location. In practice, it is probably not economical to plan for precipitation of 100% of all possible fog conditions. Being able to handle 90% would require a much smaller installation and still reduce a great deal of operational losses. In these advection fog embodiments, all areas downwind of the runway would have improved visibility when the runway visibility is restored. By virtue of this, areas around terminals, hangers, and parking lots can also have improved visibility provided they are downwind of the runway or between the runway and the EGD units.

EGD Spray Apparatus

Figure 5:
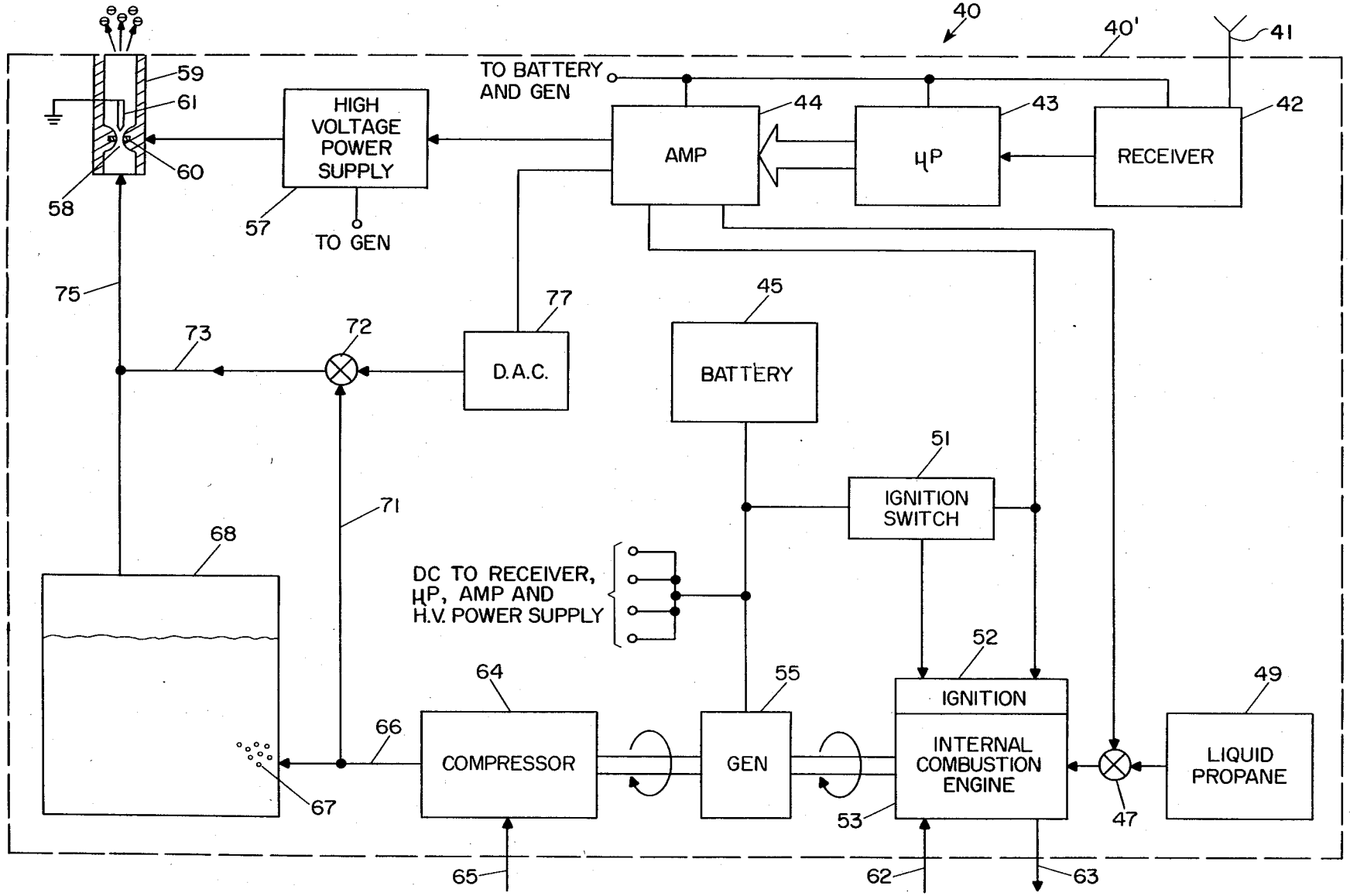
FIG. 5 is a schematic illustration in block diagram form showing a mobile EGD fog precipitation unit with heat and water supplies and controls.

Turning to the EGD units employed, a self-contained, compact EGD spray unit according to the invention can easily be moved to specific locations around the airport and is diagrammed in FIG. 5. This can be remotely controlled by radio link, and has very low maintenance and fuel costs.

In FIG. 5, the components comprising an EGD fog precipitation unit 40 are enclosed within a protective enclosure 40' indicated by a dashed line. The system is activated by a coded radio signal from the airport control tower to an antenna 41. This signal is demodulated at a receiver 42 and applied to a programmed microprocessor 43. Output of the microprocessor is amplified at an amplifier 44. Initially, one or more internal power supplies, not separately shown, of the receiver, microprocessor and amplifier are supplied standby power from a battery 45.

An amplified output signal is sent from the amplifier 44 to open a fuel valve 47 located on a liquid propane gas tank 49. Simultaneously, an enabling electric signal is sent by the amplifier to an ignition switch 51 connected between the battery 45 and the ignition 52 to start an internal combustion engine 53 coupled to a generator 55. A suitable control signal is sent from the microprocessor and amplifier to a solid-state high voltage power supply 57 that takes its input power from the generator 55. Conventionally, the generator 55 also serves to recharge the battery 45. The high voltage supply 57 activates the ionizer 58 of an EGD spray nozzle 59. The EGD nozzle may be as described in the inventor's above-referenced U.S. Pat. No. 4,433,003 and includes an attractor electrode 60 and corona needle 61 serving to form molecular ions in a convergent divergent section of dielectric channel opening upward to atmosphere.

The engine 52 ingests air, as indicated by a line 62, and exhausts hot combustion gas (exhaust), as indicated by a line 63. The engine 53 also drives a compressor 64 that takes in air, line 65, and sends warm, compressed air through an air line 66 to a bubbler 67 in a water storage tank 68. Part of the compressed air from the compressor 64 may be made to bypass the water tank 68 via a line 71 coupled to an electrically operated variable opening valve 72 that feeds a line 73. The line 73 supplies the bypassed air to an ouput air line 75 communicating from the water storage tank to the EGD nozzle 59. The more the valve 72 is opened, the lower is the humidity in the compressed air going to the EGD nozzle 59. The lower the humidity of the air supplied to the nozzle through the line 75, the smaller are the water droplets formed in the nozzle, and the higher their mobility $k_a$. Thus, the valve 72 can be adjusted to obtain a desired mobility. To this end, an output of the microprocessor 43 is, after amplification at the amplifier 44, supplied to a digital to analog converter 77 whose analog output serves to control the degree to which the valve 72 is opened. This is but one of several alternate arrangements whereby a transmitted control signal is decoded by the microprocessor to vary the valve opening. It may be that the digital to analog converter 77 is directly coupled to the pertinent microprocessor output or outputs and then amplified at the related section of the amplifier 44 or other arrangements, such as a look up table, may provide the desired valve opening output for a given input. Moreover, it will be understood that at the tower or other location of the radio control transmitter (not shown), coded information to be transmitted can be expressed initially by the operator in terms of the desired dependent variables $E_x(0)$, H, $q_a n_a$, and $\tau$ all of which define the desired space-charge cloud. In other words, inputs to the transmitter may be the desired dependent variables in which case the microprocessor 43 can calculate, or simply cause to be looked up, the appropriate valve opening to provide the correct $k_a$ based upon the foregoing equations (5)–(8). It will be recognized that not each of the four independent variables can be controlled by control of mobility $k_a$ alone, but cloud height and hence the height to which fog clearing occurs might be chosen for control, or the time constant $\tau$ (assuming quiescent fog) may be chosen to permit determination of the time required to clear a runway.

A further degree of control can be provided by use of the microprocessor 43 to control the output voltage from the high voltage power supply to the ionization electrode of the EGD nozzle 59 thereby to control current in the jet $I_j$. Finally, a measure of control of P, kinetic power of the jet may be effected either by controlling the total air introduced into the EGD nozzle 59 through the line 75 or by jointly controlling the input to the bubbler 66 along with the bypass air introduced by the line 73. After fog has been precipitated, this unit is turned off by further radio signal to the receiver 42.

The above unit requires regular maintenance about once a year. At this time, water and fuel tanks are filled and the unit is checked for $I_j$, current of the jet. It should be expected that the engine and compressor would not need to be overhauled more than once in five years because the unit can be expected not to be on, for example, more than 150 hours per year.

Figure 6:
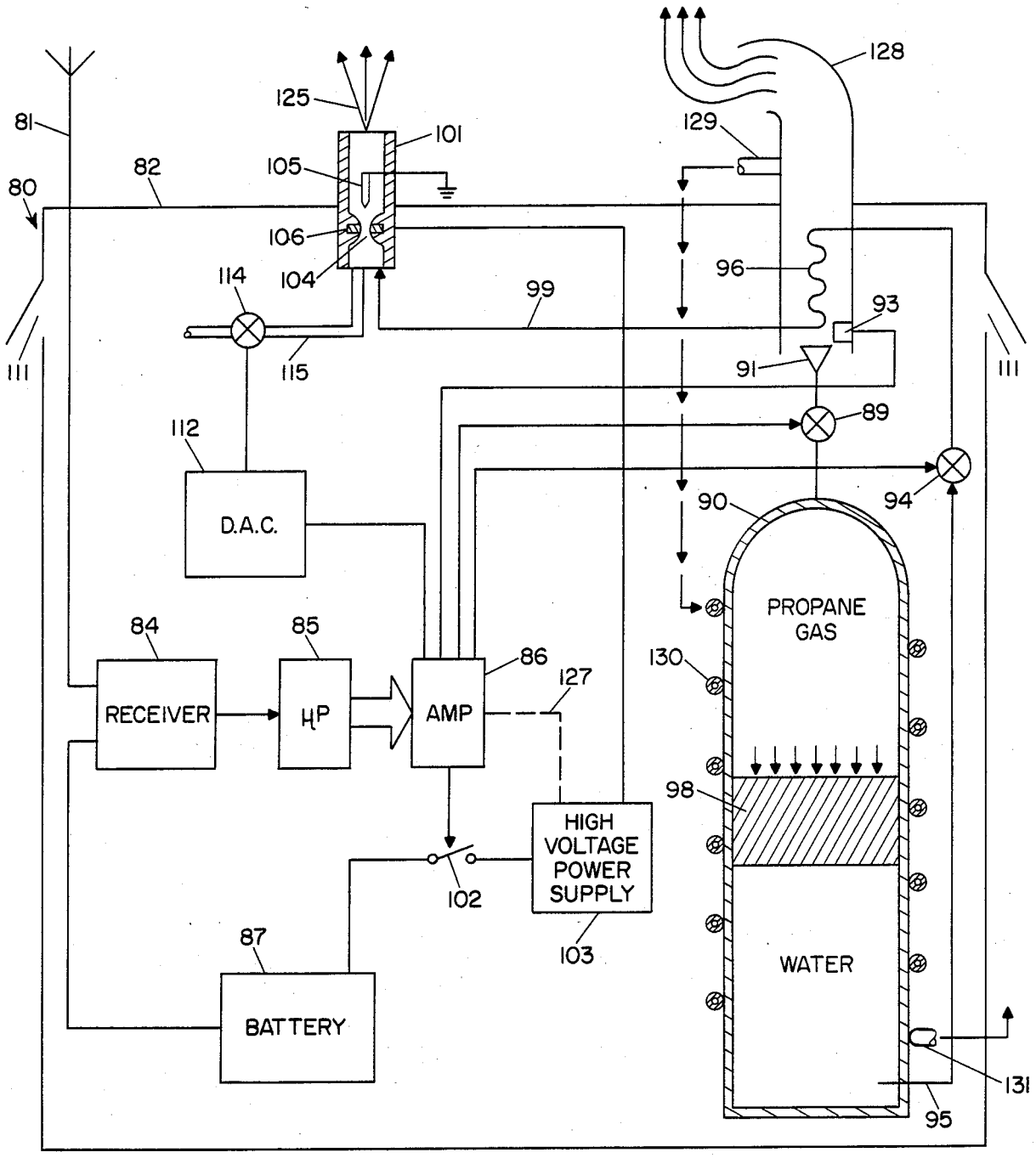
FIG. 6 is a schematic illustration in block diagram form of a mobile EGD steam spray unit.

In FIG. 6 there is shown an alternative self-contained EGD spray unit 80 having no moving parts. An antenna 81 extends through an enclosure 82 to supply signals transmitted from an airport tower to a receiver 84 coupled to a microprocessor 85 coupled in turn to an amplifier 86. Both stand-by and operating power for the receiver, microprocessor, and amplifier are supplied by a chemical battery 87. Initially, upon receipt of a coded radio signal, a control signal from the microprocessor 85, amplified by the amplifier 86, is applied to a valve 89 communicating between high pressure propane in a tank 90 and a flame holder or burner 91. Propane flowing to the burner 91 is ignited by a signal of short duration applied to an igniter 93 from the microprocessor and amplifier. At the same time, a further control signal from a microprocessor and amplifier opens a valve 94, in a line 95 communicating between water in the tank 90 and a heat exchanger 96 in heat exchange relation to the flame created at the burner 91. In the tank 90 the propane and water may be in contact or separated by a membrane or plunger 98 as shown. High propane pressure acting on the water forces water through the line 95 and the heat exchanger 96 where the water becomes superheated steam. Via a line 99 the superheated steam passes to an EGD nozzle 101. A further signal from the microprocessor and amplifier 86 closes a switch 102 between the battery 87 and a high voltage power supply 103. The high voltage power supply drives the ionizer of the EGD nozzle 101. The EGD nozzle 101 has a supersonic nozzle 104 in which there is a corona needle 105 at ground potential and an attractor ring 106 at the high potential connected thereto from the high voltage power supply 103.

Air to feed the propane flame in the burner 91 is fed into the enclosure through vents 111. In the EGD nozzle, the molecular ions emitted by the corona needle act as condensation nuclei for the supersaturated steam. Condensate forms on the ions, and a supersonic jet 125 exiting the nozzle contains charged submicron sized droplets of water. The size and mobility of these charged aerosols can be adjusted by controlled introduction of air from within the enclosure into the nozzle and along the dielectric supersonic channel thereof. As in the preceding embodiment, the amount of air introduced from the enclosure into the nozzle can be controlled from the airport tower via the radio link to the receiver 84. The microprocessor 85 and amplifier 86 provide a digital output to a digital to analog converter 112. The analog output of the converter 112 controls an electrically operated variable opening valve 114 in an air supply line 115 to the nozzle 101. Again the mobility $k_a$ of the submicron sized particles emitted and the kinetic power P of the jet are varied to vary the characteristics of the space-charge cloud precipitating the fog. Again, the microprocessor and amplifier may be used to vary the high voltage applied to the attractor 106 to vary the current $I_j$ in the jet under command from the airport tower via the receiver 84. The optional control of an attractor electrode potential is indicated by the control connection 127 shown as a broken line between the amplifier 86 and the high voltage power supply 103.

Combustion gas exits the unit through the exhaust pipe 128. In cold weather, some of this gas can be diverted around the propane and water in the tank 90 to keep it warm and maintain high propane gas pressure as indicated at the exhaust gas path 129 leading to heat exchange coils 130 and exhaust path 131.

The mobile EGD spray unit of FIG. 6 is silent, having no moving parts. Because it is light in weight and easily movable it is ideally suited for precipitating fog and/or smoke over wide areas, making it particularly useful where events leading to decrease of visibility are infrequent and of short duration or where the direction of the wind is unpredictable.

In summary, the EGD method of airport fog precipitation has many advantages over the only other method of fog removal now in operation, the thermal method. Both of the units, FIGS. 5 and 6, are relatively compact and portable and can be installed without trenching. Installation time and costs is far less than the deployment of numerous jet engines in a thermal installations mentioned above. Because the propane burns cleanly, there is no air pollution. The systems employing these units use far less fuel, cost less to operate than the thermal installations. Visibility can be maintained continuously permitting more frequent landings. There is no severe turbulence created so that smaller aircrafts can use the system safely. Areas downwind of a cleared runway are cleared, as well. The units may easily be deployed to clear areas other than runways.

It will be understood that while the foregoing description is directed principally to airport fog precipitation it may well be that other areas such as harbors, highways and parking lots. Any airborne particulate can be cleared in the manner of this invention, for example, smoke, haze, mist, smog. Larger areas than airports can benefit where airborne particulates are persistent, recurrent problems, such as in the Los Angeles smog basin. Military applications may include the clearing of smoke screens and the scrubbing of poisonous gas from a tactical area. While specific preferred embodiments are described above, it will be understood that variations and modifications of these may be made without departure from the spirit and scope of the invention as described in the appended claims.

I claim:

1. A method of precipitating airborne particles of fog, haze, smog and the like in an unconfined portion of the atmosphere to ground including:

(a) providing an array of charged submicron water droplet nozzles having a mean spacing S between the nozzles of the array;

(b) selecting characteristics of a cloud of charged submicron droplets to be produced by the array including:

(1) a field strength $E_x(0)$ of the cloud at the ground;

(2) a height H of the cloud;

(3) a charge concentration of $q_a n_a$, wherein $q_a$ is the average charge of a submicron droplet and $n_a$ is the concentration of charged submicron droplets;

(4) a time constant $\tau$; providing the nozzle array with the average spacing S, average kinetic power $P_j$ of the jets, average current $I_j$ in the jet, mobility of emitted charged submicron droplets $k_a$ and mobility of the charged fog drops $k_b$ such that S, $P_j$, $I_j$ $k_a$ and $k_b$ provide the selected values of $E_x(0)$, H, $q_a n_a$ pursuant to the relationships:

$$E_x(0) \propto S^{-\frac{2}{3}} P_j^{\frac{1}{3}} k_a^{-\frac{1}{3}},$$

$$H \propto S^{\frac{2}{3}} P_j^{\frac{2}{3}} I_j^{-1} k_a^{\frac{1}{3}},$$

$$q_a n_a \propto S^{-4/3} P_j^{-\frac{1}{3}} I_j k_a^{-\frac{2}{3}},$$

$$\tau \propto S^{4/3} P_j^{\frac{1}{3}} I_j^{-1} K_a^{-\frac{1}{3}} (k_b/k_a)^{-1},$$

and emitting charged submicron water droplets from the nozzles, the water droplets having the above-recited characteristics, whereby clearing of the airborne particles occurs to substantially the height H by attachment of the emitted submicron droplets to the airborne particles and precipitation of the thus charged airborne particles to the ground.

2. The method according to claim 1 wherein:

(a) the field strength $E_x(0)$ of the cloud at the ground is in the range $10^5$ volts/m to $10^6$ volts/m;

(b) the height H of the cloud is at least 20 m;

(c) the concentration $q_a n_a$ is in the range $10^{-8}$ to $10^{-6}$ coulombs/m$^3$; and (d) the time constant $\tau$ is a maximum of 1,000 sec.

3. The method according to claim 2, wherein said field strength, cloud height and concentration are produced by providing an array of the following characteristics:

(a) the mean spacing S is in the range 100 to 150 m;

(b) the kinetic power $P_j$ of the jets is in the range 50 to 2000 watts;

(c) average current $I_j$ in the jets is in the range from $10^{-5}$ to $10^{-3}$ amp; and (d) droplet mobility $k_a$ is in the range $10^{-8}$ to $10^{-6}$ m$^2$/volts sec.

4. The method according to claim 2 including producing a cloud of a field strength $E_x(0)$ at the ground of at least $7\times10^5$ volts/m, and a concentration $q_a n_a$ of at least $1.5\times10^{-7}$ coulombs/m$^3$.

5. The method according to claim 4 wherein the step of producing the cloud includes providing for the array of spray units an array of EGD nozzles with jet radius $r_j$, from $2.25\times10^{-3}$ to $4\times10^{-3}$ m, with a mean spacing S of 100 to 150 m, a kinetic power $P_j$ of the jets of 1100 to 1400 watts, an average current $I_j$ in the jets of $1\times10^{-4}$ to $1\times10^{-4}$ amps, and droplet mobility $k_a$ of $1\times10^{-8}$ to $1\times10^{-7}$ m$^2$/volts sec.

6. The method according to claim 2 including producing a cloud of a field strength $E_x(0)$ at the ground of $3\times10^5$ to $4.5\times10^5$ volts/m, a concentration $q_a n_a$ of at least $7.5\times10^{-8}$ coulombs/m$^3$.

7. The method according to claim 6 wherein the step of producing the cloud includes providing for the array of spray units an array of EGD nozzles with jet radius $r_j$, from $1.25\times10^{-3}$ to $2.25\times10^{-3}$ m, with a mean spacing S of 100 to 150 m, a kinetic power $P_j$ of the jets of 200 to 400 watts, an average current $I_j$ in the jets of $7\times10^{-5}$ to $1\times10^{-4}$ amps, and droplet mobility $k_a$ of $1\times10^{-7}$ to $1.5\times10^{-7}$ m$^2$/volts sec.

8. The method according to claim 2 including producing a cloud of a field strength $E_x(0)$ at the ground of $2\times10^5$ to $3\times10^5$ volts/m, and a concentration $q_a n_a$ of at least $6\times10^{-8}$ coulombs/m$^3$.

9. The method according to claim 8 wherein the step of producing the cloud includes providing for the array of spray units an array of EGD nozzles with jet radius $r_j$, from $0.25\times10^{-3}$ to $1.25\times10^{-3}$ m, with a mean spacing S of 100 to 150 m, a kinetic power $P_j$ of the jets of 100 to 200 watts, an average current $I_j$ in the jets of $4\times10^{-5}$ to $7\times10^{-5}$ amps, and droplet mobility $k_a$ of $1.5\times10^{-7}$ to $2.5\times10^{-7}$ m$^2$/volts sec.

10. The method according to claim 1 wherein the step of providing an array includes locating the spray units in a square array comprising a grid of squares with sides of length S and having one of said spray units located at each corner of each of the squares in the grid.

11. The method according to claim 1, and comprising the step of deploying the spray units in the array a treatment distance y upwind of an airport to precipitate fog drops being carried at speed u towards the runway, and to produce a preselected range of visibility along the runway.

12. The method according to claim 11, said fog having an initial concentration $n_b(y)$ and visibility range V(y), and wherein the relationship between the final values of concentration and visibility range, $n_b(r)$ and V(r), respectively, at the runway and said treatment distance y, is $$n_b(y)/n_b(r) = V(r)/V(y) = exp(y/\lambda), \text{ and}$$

where, the characteristic precipitation length, is $$\lambda = u\tau = u\frac{H}{k_a}E_x(0).$$

13. A method of precipitating fog carried towards an airport runway at speed u including locating at least one row of charged submicron size water droplet spray units a distance y' upwind of said runway, the fog having initial concentration $n_b(y')$ and visibility range V(y'), emitting water droplets from said units and altering the concentration and visibility values $n_b(r)$ and V(r) at the runway in dependance on the treatment distance y' as follows:

$$n_b(y')/n_b(r) = V(r)/V(y') = 1 + y'/\lambda, \text{ and}$$

where, the precipitation characteristic length is $$\lambda = u\tau = u\frac{H}{k_b}E_x(0),$$

and wherein $\tau$ is the time constant, H is the height, $k_b$ is the charged fog drop mobility, and $E_x(0)$ is the field strength at the ground of the space-charge cloud at the location of the EGD spray units.

14. The method according to claim 13 wherein the step of locating at least one row comprises locating on the ground large EGD spray units having jet radii $r_j$ from $2\times10^{-3}$ to $4\times10^{-3}$ m.

15. The method according to claim 13 wherein the step of locating at least one row comprises placement of a row of small EGD spray units of jet radii $r_j$ from $0.5\times10^{-3}$ to $1.25\times10^{-3}$ m mounted on structural supports above the ground.

16. A method of precipitating airborne particles of fog, haze, smoke, smog and the like in an unconfined portion of the atmosphere including:

(a) providing an array of electrogasdynamic nozzles;

(b) emitting a cloud of charged submicron droplets of just one polarity from the nozzles;

(c) adjusting the mobility $k_a$ of the charged submicron droplets to determine the characteristics of the cloud including the height H and charge concentration $q_a n_a$ thereof, where $q_a$ is the average charge of a droplet and $n_a$ is the concentration of emitted droplets, the step of adjusting the mobility includes increasing the mobility of the droplets of one polarity to increase the height and decrease the charge concentration or decreasing the mobility to decrease the height and increase the charge concentration.

17. The method according to claim 16 wherein the step of adjusting the mobility includes controlling the size of the droplets.

18. The method according to claim 17 wherein the step of controlling the size of the droplets includes introducing a controlled amount of atmospheric air into the nozzles to be emitted with the droplets.

19. The method according to claim 16 further comprising the step of altering the charge applied to the submicron particles in the nozzles to alter the characteristics of the cloud.

* * * * *

UNITED STATES PATENT AND TRADEMARK OFFICE

CERTIFICATE OF CORRECTION

PATENT NO. : 4,671,805

DATED : June 9, 1987

INVENTOR(S) : Meredith C. Gourdine

It is certified that error appears in the above-identified patent and that said Letters Patent is hereby corrected as shown below:

Col. 2, line 7, after "26"," delete --1--.

Col. 3, line 11, "droplers" should be --droplets--.

Col. 4, line 38, "Preferable" should be --Preferably--;

Col. 4, lines 46-47, "hangers" should be --hangars--.

Col. 7, line 54, "Table III" should read --Table II--;

Col. 7, line 55, "like--" should read --like--;

Col. 7, line 65, "32 0.50" should read -- = 0.50--.

Col. 9, line 30, "therefor" should be --therefore--;

Col. 9, line 61, "hangers" should be --hangars--.

Col. 12, line 43, "a" should be --the--;

Col. 12, line 55, "that" should be --used for--.

UNITED STATES PATENT AND TRADEMARK OFFICE

CERTIFICATE OF CORRECTION

PATENT NO. : 4,671,805

DATED : June 9, 1987

INVENTOR(S) : Meredith C. Gourdine

It is certified that error appears in the above-identified patent and that said Letters Patent is hereby corrected as shown below:

Col. 13, line 15, "providing ..." should start a new line at the left-hand margin;

Col. 13, line 67, "$1 \times 10^{-4}$" (second occurrence) should read --$2 \times 10^{-4}$--.

Signed and Sealed this

Twenty-fourth Day of May, 1988

*Attest:*

DONALD J. QUIGG

*Attesting Officer*

*Commissioner of Patents and Trademarks*